United States Patent [19]

Manning

[11] 4,062,324

[45] Dec. 13, 1977

[54] FIRETUBE ECONOMIZER

[75] Inventor: William P. Manning, Tulsa, Okla.

[73] Assignee: Combustion Engineering, Inc., Windsor, Conn.

[21] Appl. No.: 691,748

[22] Filed: June 1, 1976

[51] Int. Cl.[2] ..... F22B 7/06

[52] U.S. Cl. ..... 122/145; 122/153; 122/150

[58] Field of Search ..... 122/140, 141, 142, 144, 122/145, 146, 147, 148, 149, 150, 153

[56] References Cited

U.S. PATENT DOCUMENTS

| | | | |
|---|---|---|---|
| 313,327 | 3/1885 | Harmon | 122/147 |
| 610,681 | 9/1898 | Joy | 122/147 |
| 2,451,321 | 10/1948 | Crotty | 122/145 |
| 3,028,843 | 4/1962 | Carlson et al. | 122/149 |
| 3,259,107 | 7/1966 | Dalin | 122/140 |
| 3,766,891 | 10/1973 | Csathy et al. | 122/149 |

*Primary Examiner*—Kenneth W. Sprague
*Attorney, Agent, or Firm*—Arthur L. Wade

[57] ABSTRACT

A firetube is mounted in a body of liquid to transmit heat to the liquid. A burner of fluid fuel is attached to one end of the firetube to discharge products of combustion into the firetube. The cooled products are discharged from the other end. The last portion of the firetube in the liquid bath has a series of tubes mounted through its walls. Liquid of the bath passes through the tubes and is heated by the products of combustion in contact with the tubes from within the firetube.

1 Claim, 3 Drawing Figures

FIRETUBE ECONOMIZER

BACKGROUND OF THE INVENTION

1. Field of the Invention

The invention relates to increasing the surface of firetubes in which the products of combustion from a burner increase the temperature of the liquid surrounding the firetube. More specifically, the invention relates to an increase in the surface of a portion of the firetube by a series of tubes mounted through the portion with the products of combustion on the external side of the tubes and the liquid to be heated on the internal side of the tubes.

2. Description of the Prior Art

There appears to be little drama remaining in the development of the firetube art. As sources of heat, these units are now all too familiar as conduits of various sizes which are extended through liquids to be heated. A burner of fluid fuel is conventionally mounted to discharge products of combustion into one end of each conduit. The heat from the products of combustion is transmitted through the walls of the conduit. The amount of heat released into the firetube and conducted into the liquid on the external side of the firetube is largely a factor of the size of the surface provided by the configuration of the firetube.

Directly related to the heat released within the firetube, and subsequently absorbed by the external liquid, is the final temperature of the products of combustion discharged from the end of the firetube as a conduit. The lower the final temperature, the more complete the heat transfer. This final temperature is often referred to as the "stack gas temperature." Hereafter, the products of combustion may be also called the firetube gases.

The focus of attack on stack gas temperature has been to increase the surface area of the firetube. For example, longitudinal fins have been mounted on the inside of the firetubes. However, those fins inherently tend to stagnate the film of heat exchange medium at the surface of the firetube. Also there is a structural problem with the fins which arises from the large temperature gradient between the hot tip in contact with the firetube gases and the cold base which is connected to the firetube wall.

Of course, a fin could be mounted in a spiral form on the inside of the firetube. This design would keep the flowing medium dynamic. However, it is not feasible to manufacture helical fins mounted internal a firetube.

Not to be overlooked are the heat exchange sections separately fabricated and mounted in the discharge section of the firetube. The liquid to be heated by the firetube proper can be preheated by the discharging stack gas in these sections. In either event, these sections scavange, conserve, recycle the heat of the firetube stack back to the basic process and thereby increase the overall efficiency of the process.

The basic difficulty with the separate heat exchange sections is that a pump is required to move the heat exchange fluid through the section and back to the basic process. Not only does this approach require the pump, but its operating and safety control system with all their expense of service, repair, and replacement.

In summation, there is the problem of providing a constructive increase in the surface area of the firetube. Both the surface exposed to the product of combustion flowing within the tube and the surface exposed to the liquid external the tube should be increased. Internal fins of the tube either cannot be given an efficient form or be fabricated practically. Additionally, internal fins do not increase the surface exposed to the liquid to be heated. Further, there is the problem of flowing the fluids over the heat exchange surfaces without the addition of pumping means. The question remains, "How are the surfaces of the firetube exposed to both the internal and external heat exchange fluids to be increased without the addition of a heat exchange section and without the addition of pumping means?"

SUMMARY OF THE INVENTION

It is an object of the invention to enlarge the heat exchange surface of a firetube conduit by means of tubes mounted through the latter section of the conduit which is in contact with the external liquid.

Another object is to mount the tubes so that fluid external to the firetube will automatically flow through the tubes during the period when products of combustion are generated in the firetube.

The present invention contemplates a modification of the last section of a firetube conduit to enlarge the surface area between the products of combustion released within the firetube conduit and the liquid external the firetube as a conduit. The modification includes mounting a series of tubes inside the section to extend transverse the axis of the tubular conduit section. Fins are mounted on the external surface of the tubes for extended surface contact with the products of combustion. The interior of each tube is open to the liquid external to the section for free, or natural, circulation of the liquid through the tubes.

Other objects, advantages, and features of the invention will become apparent to one skilled in the art upon consideration of the written specifications, appended claims, and attached drawings.

DRAWING DESCRIPTION

DESCRIPTION OF THE PREFERRED EMBODIMENT

This invention is one of my series of recent improvements in the industrial indirect heater. The disclosure of U.S. patent application Ser. No. 675,109, filed Apr. 21, 1976, by W. P. MANNING demonstrates how control of the secondary combustion air to the burner of these indirect heaters, parallel with the regulation of fuel to the burner, could provide a significant increase in the thermal efficiency of the units. Now that the quality of the heat released by the burner has been improved, the conservation of that heat is of present concern.

Figure 1:
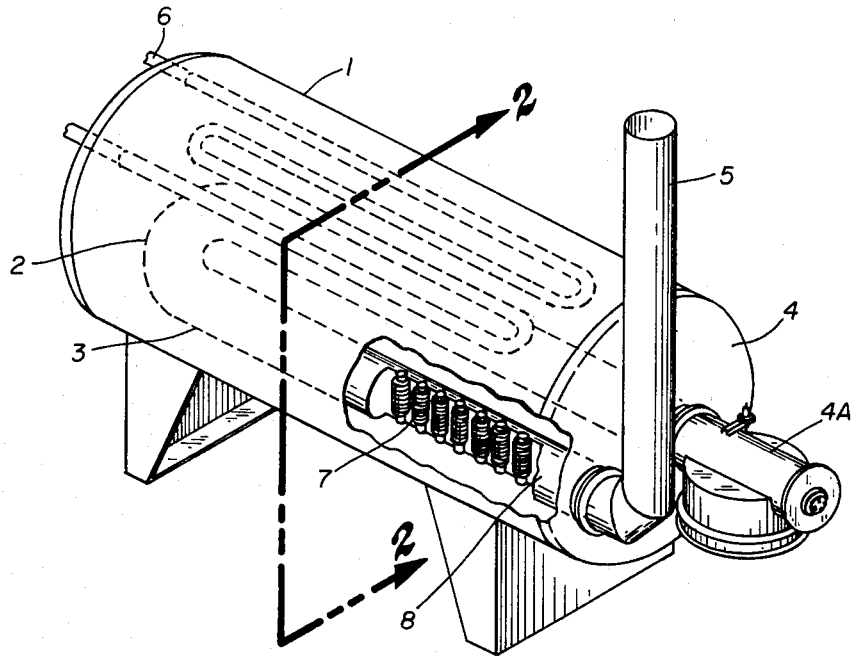
FIG. 1 is a sectioned perspective of an industrial indirect heater in which the invention is embodied.
Figure 2:
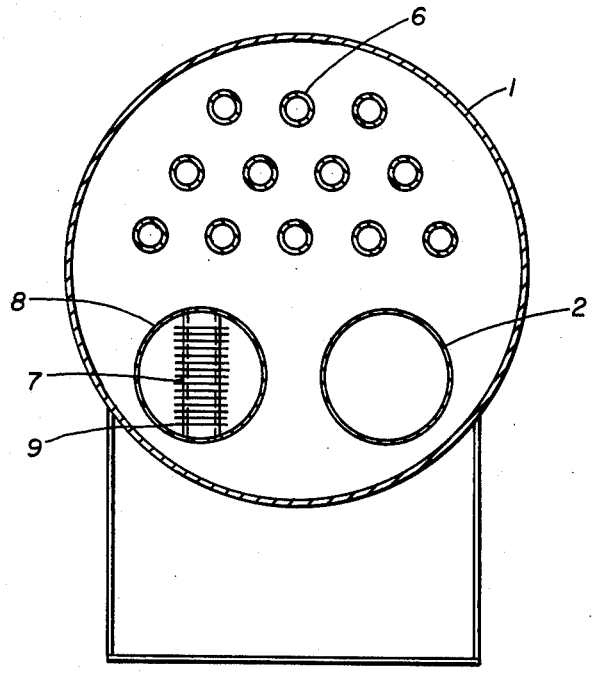
FIG. 2 is a sectioned end view of FIG. 1 taken along lines 2—2 in FIG. 1.

FIG. 1 of the drawings should now be understandable. An indirect heater unit is depicted. Shell 1 is, essentially, a horizontally extended cylinder containing a liquid bath. The specific liquid is of no present consequence. Firetube 2 is a conduit, the major portion of its middle section 3 extended through the lower volume of the liquid bath.

The middle section 3 is formed in what is commonly called a U-turn, or return bend. The entrance and exit ends of this section 3 are fixed to the head 4 of the shell 1. The entrance to the firetube receives the products of combustion generated by a burner not shown in detail at 4A. The products of combustion flow down the middle section 3, turn 180° in the return bend, and discharge up stack 5 which is connected to the exit end of the firetube 2. In their flow down the middle section 3 the products of combustion give up a portion of their heat to the liquids of the bath. These liquids, in turn, give up a portion of their heat to the reaches of tubular conduit 6. The working fluid flowed through conduit 6 is thereby heated. This process of indirect heat exchange is simple and straightforward. However, the firetube, as a bare conduit, does not transfer as much heat to the surrounding liquids as desired. Of course, any heat not transferred flows out stack 5 and is lost to the process.

The stack gas temperature is per se evidence, or a measure, of the efficiency of the heat transfer process. A temperature much above 500° F is evidence of waste and inefficiency in the process. The bare firetube conduit must have its surface area increased to transfer more heat and lower the stack gas temperature. This the present invention does.

To be quite specific, invention is embodied in one, or more, tubular members 7 located in the second section 8 of firetube 2. These tubes or pipes, 7 are but simple conduits extended through this second section, normal to the axis of the firetube as a conduit.

In further detail, each tube 7 is sealed about the pair of aligned openings of the second section 8 by which the tube 7 is extended through the wall of the firetube. Note fins 9 are attached to the external surface of each tubular member 7. Helical or disc, these fins 9 extend the surface of the tube 7, and therefore the internal surface of the firetube. So mounted, this extended surface increases the contact with the products of combustion flowing in the firetube.

The internal walls of tubes 7 are open to the liquid of the bath about the firetube. The external walls and fins 9 are in contact with the gases within the firetube. Both surfaces are a constructive part of the heat exchange surface of the second section 8. Therefore, these tubes make a significant increase in the heat exchange surface area of the firetube 2.

The tubes 7 are disclosed in the drawing as vertically oriented. It is certainly easy to align the tubes in this way, simply moving along this section 8 and forming the holes one after the other. On the other hand, more turbulence could be created in the bath liquid in inclining the tubes at various angles. The liquid heated within each tube 7 and discharged upwardly from that tube causes a degree of turbulence. If the tubes are inclined at various angles, their discharges could spread and enlarge the turbulence through the body of liquid above the firetube.

The refinement of tubular member 7 inclination was not specifically disclosed in the drawing. However, it is evident how this arrangement would give an improvement in the agitation of the liquid of the bath which would then result in a further improvement in the heat exchange from the liquid to the tubular conduit 6.

OPERATION

It is practically evident from inspection how the structure of the invention actually works. The firetube 2 is heated by the burner combustion under a control system responsive to the demand for the heat. Thus usually means the working fluid in conduit 6 is colder than desired.

Heat in the products of combustion is transferred by the fins and walls of tubes 7 to liquid of the bath in the tubes 7. Expansion and/or partial vaporization of the liquid in the tubes causes the liquid to flow upward. The heated liquid in the tubes 7 is replaced by cooler liquid below the tubes. The heated liquid flows up to contact conduit 6 and transfers the heat to the working liquid. The system is totally automatic. When the burner at 5 is on and the products of combustion are hot, the liquid in the pipes heats up and rises; and when the burner is turned off the pipes cool and the liquid flow subsides.

TESTS OF ACTUAL REDUCTION TO PRACTICE

Considering the apparent simplicity of the invention, the improvement it makes in the efficiency of the industrial, indirect heater is outstanding. This is an art where each 5% increase in gross thermal efficiency (GTE) saves tremendous amounts of energy over very short spans of time. The test of the actual reduction to practice of this invention demonstrated an addition of over 10% to the GTE. The all-important payout of the added cost to the fabrication of these heaters has readily calculated at well under a year. In this industry a three-year payout is a normal expectation for improvements in equipment.

The test heater had a shell 1 of 36 inches OD and a 10 ft. length. Its firetube 2 was in the order of 10 inches in diameter. The burner 4A was a 2 inch John Zink long flame type with a RHSB model 100 pilot with a No. 61 orifice. The stack 5 was 12 ft. high. The conduit 6 was a one flow path, 14 pass, 2 inch schedule 80 pipe coil bundle.

The invention was embodied in one row of seven 3 inch schedule 40 pipes spaced 7 inches apart along the last length of the firetube. The fins were 24 fins/lineal ft., ¾ inch high and 0.105 inch thick. This construction increased the surface area of the firetube from 52 to 72 square feet.

The test runs were somewhat complicated because the invention of the U.S. patent application Ser. No. 675,109, filed Apr. 21, 1976 was included in the heater and many of the test runs were made to determine the cummulative increase in efficiency. However, enough data was taken to determine that the present invention added well over 10% GTE to the heater performance.

During the tests the stack gas temperature ranged from 400° to 640° F, dependent upon the firing rate. It is well to point out that the temperature of the stack gas cannot be allowed to reach the level where corrosive sulphur compounds in the fuel will condense on the surfaces of the firetube and stack. Therefore, as a practical matter, 500° F is usually regarded as the lowest desired temperature in this art.

Figure 3:
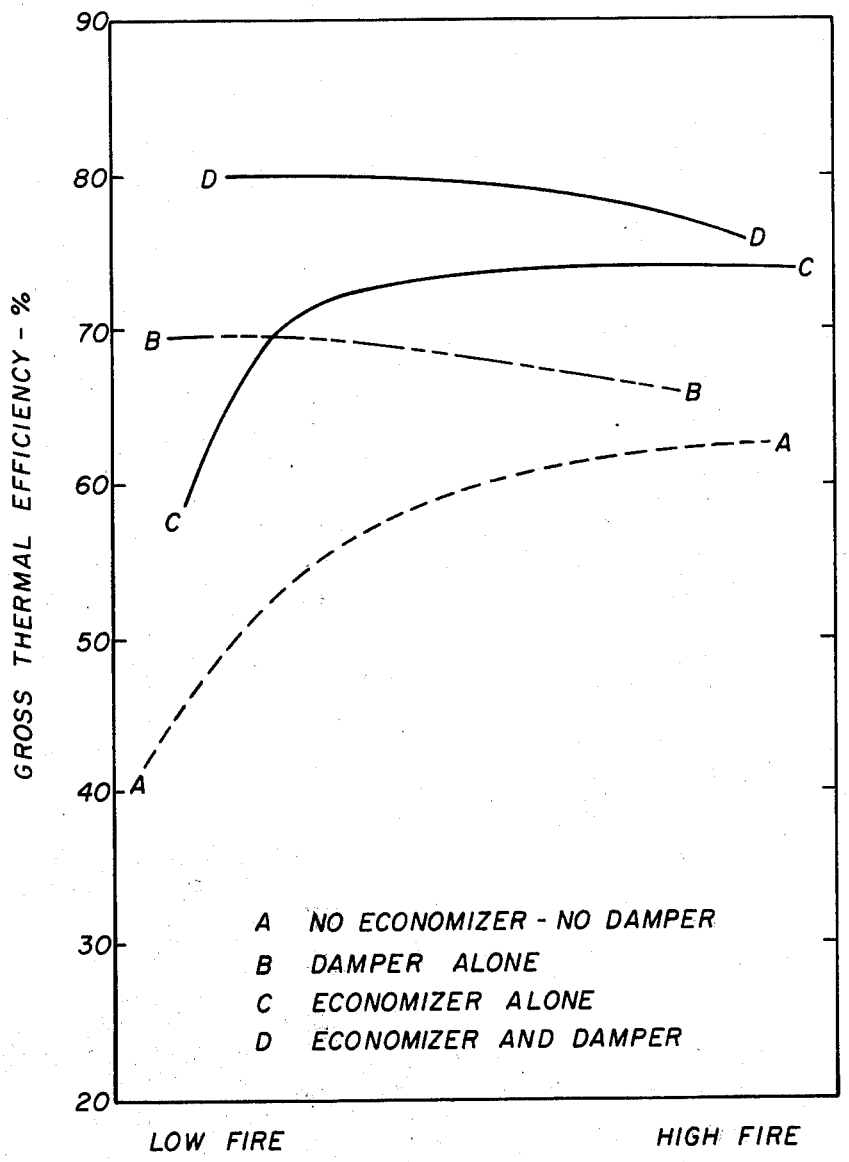
FIG. 3 is a graph of the efficiency achieved with the invention.

The graph of FIG. 3 is a reflection of actual data from test runs of the reduction to practice. The heater was carefully operated with no control of its excess air and without the economizer installed. Plot A over a significant range of heat release gives a base line of what can be expected of the prior art. The efficiency, at its maximum, did not reach 65%.

A control for excess air was then installed with the separator of my U.S. patent application Ser. No. 675,109, filed Apr. 21, 1976. Plot B shows the resulting improvement in efficiency. A maximum of 70% was obtained.

The present invention was then installed in the firetube. Plot C is the result, demonstrating the marked increase in GTE of well over 10%. There is no doubt remaining, from this data, but that this invention is another significant advance in this art.

Perhaps incidentally, the industrial heater was tested over the range of operation with both the present invention and the control system for excess air. Plot D shows the synergistic effect on GTE of both improvements. The GTE ranged from 76 to 80%. Compared with the prior art of plot A, plot D clearly demonstrates a giant step forward, based in large measure of the present invention.

CONCLUSION

There is virtue in restating what may now be obvious from the foregoing disclosure. The invention is embodied in a firetube, as a conduit, mounted in a liquid bath. Included in the combination is a burner mounted to discharge products of combustion into the entrance of the firetube. The entrance is one of the two ends of the firetube.

A stack is mounted on the second end of the firetube to receive the products of combustion and guide them toward a satisfactory point of discharge. Between this stack and the upstream barrier is the working portion of the firetube. The working portion of the firetube is defined in two sections, both surrounded by the liquids of the bath to which heat is transferred.

The first section of the firetube receives the product of combustion directly from the burner and transfers a large portion of their heat to the liquid bath. The second section is that part of the working portion of the firetube through which the tubular members are extended and are open to the liquid at both ends while sealed to the wall of the firetube. Fins are mounted on the external surface of the tubular members, and within the firetube, in which location they contact the products of combustion flowing within the firetube to the stack.

The finned surface area of the tubular members therefore becomes an extension of the surface area of the firetube. The result is a configuration for the firetube which increases the area of contact between the combustion products and liquid and therefore increases the heat exchange.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted an illustrative and not in a limiting sense.

The invention, having been described, what is claimed is:

1. An indirect heater, including,
   - a container having a substantially horizontal chamber,
   - a body of liquid to be heated in the chamber,
   - a firetube in the form of a U-turn positioned within the chamber,
   - a burner mounted in a first end of the firetube to discharge products of combustion into the firetube,
   - a stack connected to the second end of the firetube and extending vertically upward to discharge the products of combustion from the firetube,
   - a plurality of aligned tubular members extended through the portion of the U-turn form of firetube which is closely adjacent the connection to the stack, each tubular member,
     - a. extended vertically through the firetube portion so as to be open to the body of liquid at both its ends and sealed to the walls of the firetube portion to contact the products of combustion with its external surface within the firetube portion, and
     - b. fins mounted on the external surface of the tubular members and in contact with the products of combustion,
   - the burner set to fire at the rate and the firetube sized and the number of tubular members fixed to provide a temperature for the products of combustion discharged from the stack in the range of 400° to 640° F and a GTE over 70%,
   - and a member to be heated mounted in the body of liquid above the firetube,
   - whereby as liquid of the body in the chamber is heated it flows upward to contact the member while cooler portions of the liquid below the firetube flow up through the tubular members as the liquid is heated in the tubular members.

* * * * *